US007509694B2

(12) United States Patent
Chen

(10) Patent No.: US 7,509,694 B2
(45) Date of Patent: Mar. 31, 2009

(54) COMBINED CRIB AND PLAYPEN ASSEMBLY

(75) Inventor: Shun-Min Chen, Taipei (TW)

(73) Assignee: Wonderland Nurserygoods Co., Ltd., Taipei (TW)

( * ) Notice: Subject to any disclaimer, the term of this patent is extended or adjusted under 35 U.S.C. 154(b) by 0 days.

(21) Appl. No.: 11/955,897

(22) Filed: Dec. 13, 2007

(65) Prior Publication Data

US 2008/0086813 A1 Apr. 17, 2008

Related U.S. Application Data

(62) Division of application No. 11/179,443, filed on Jul. 12, 2005, now Pat. No. 7,346,943.

(30) Foreign Application Priority Data

Apr. 22, 2005 (CN) ..... 2005 2 0016370 U

(51) Int. Cl.
*A47D 7/00* (2006.01)
*A47D 13/02* (2006.01)

(52) U.S. Cl. ..... 5/93.1; 5/98.1; 5/416

(58) Field of Classification Search ..... 5/93.1, 5/93.2, 94, 95, 98.1, 99.1, 416, 655, 101
See application file for complete search history.

(56) References Cited

U.S. PATENT DOCUMENTS

| | | | |
|---|---|---|---|
| 5,867,850 | A | 2/1999 | Mariol |
| 6,539,563 | B1 | 4/2003 | Hsia |
| 2002/0016991 | A1 | 2/2002 | Brown et al. |
| 2005/0210580 | A1 | 9/2005 | Clapper |
| 2006/0218725 | A1 | 10/2006 | Carpenter et al. |
| 2006/0225205 | A1 | 10/2006 | Troutman |

FOREIGN PATENT DOCUMENTS

| | | |
|---|---|---|
| GB | 2 333 034 A | 7/1999 |

*Primary Examiner*—Alexander Grosz
(74) *Attorney, Agent, or Firm*—The Webb Law Firm

(57) ABSTRACT

A combined crib and playpen assembly includes a playpen body, a hanging bed, and a bassinet unit. The playpen body has a first bottom wall, and a first surrounding wall connected to and cooperating with the first bottom wall to define a first receiving space. The hanging bed is disposed removably within the first receiving space, and includes a second bottom wall spaced a part vertically from the first bottom wall, and a second surrounding wall connected to and cooperating with the second bottom wall to define a second receiving space. The bassinet unit includes a base plate disposed removably on the second bottom wall, and at least one bassinet member supported by the base plate and defining a third receiving space which is smaller than the second receiving space.

8 Claims, 6 Drawing Sheets

COMBINED CRIB AND PLAYPEN ASSEMBLY

CROSS REFERENCE TO RELATED APPLICATIONS

This application is a divisional application of co-pending U.S. patent application Ser. No. 11/179,443 filed Jul. 12, 2005 which is incorporated herein by reference and which claims priority to Chinese Application No. 200520016370.0, filed on Apr. 22, 2005.

BACKGROUND OF THE INVENTION

1. Field of the Invention

The invention relates to a crib, more particularly to a combined crib and playpen assembly.

2. Description of Related Art

Referring to FIG. 1, a conventional baby crib 1, as disclosed in British Patent No. 2333034, has a fixed divider 11 across its center to divide the baby crib 1 into two bed sections 12 for accommodating two babies simultaneously. However, since the divider 11 of the conventional baby crib 1 is fixed, when the babies grow older and larger, spaces within the bed sections 12 become too cramped for the babies. Hence, an improvement of the conventional baby crib 1 is necessary.

SUMMARY OF THE INVENTION

Therefore, the object of the present invention is to provide a combined crib and playpen assembly that can selectively accommodate one or two babies as desired and that is capable of overcoming the aforementioned drawback of the prior art.

According to one aspect of this invention, a combined crib and playpen assembly comprises a playpen body, a hanging bed, and a bassinet unit. The playpen body has a first bottom wall, and a first surrounding wall connected to and cooperating with the first bottom wall to define a first receiving space. The hanging bed is disposed removably within the first receiving space, and includes a second bottom wall spaced apart vertically from the first bottom wall, and a second surrounding wall connected to and cooperating with the second bottom wall to define a second receiving space. The bassinet unit includes a base plate disposed removably on the second bottom wall, and at least one bassinet member supported by the base plate and defining a third receiving space which is smaller than the second receiving space.

According to another aspect of this invention, a bassinet assembly comprises a base plate, and at least one bassinet member supported by the base plate and defining a receiving space.

BRIEF DESCRIPTION OF THE DRAWINGS

Other features and advantages of the present invention will become apparent in the following detailed description of the preferred embodiments with reference to the accompanying drawings, of which.

DESCRIPTION OF THE PREFERRED EMBODIMENTS

Figure 1:
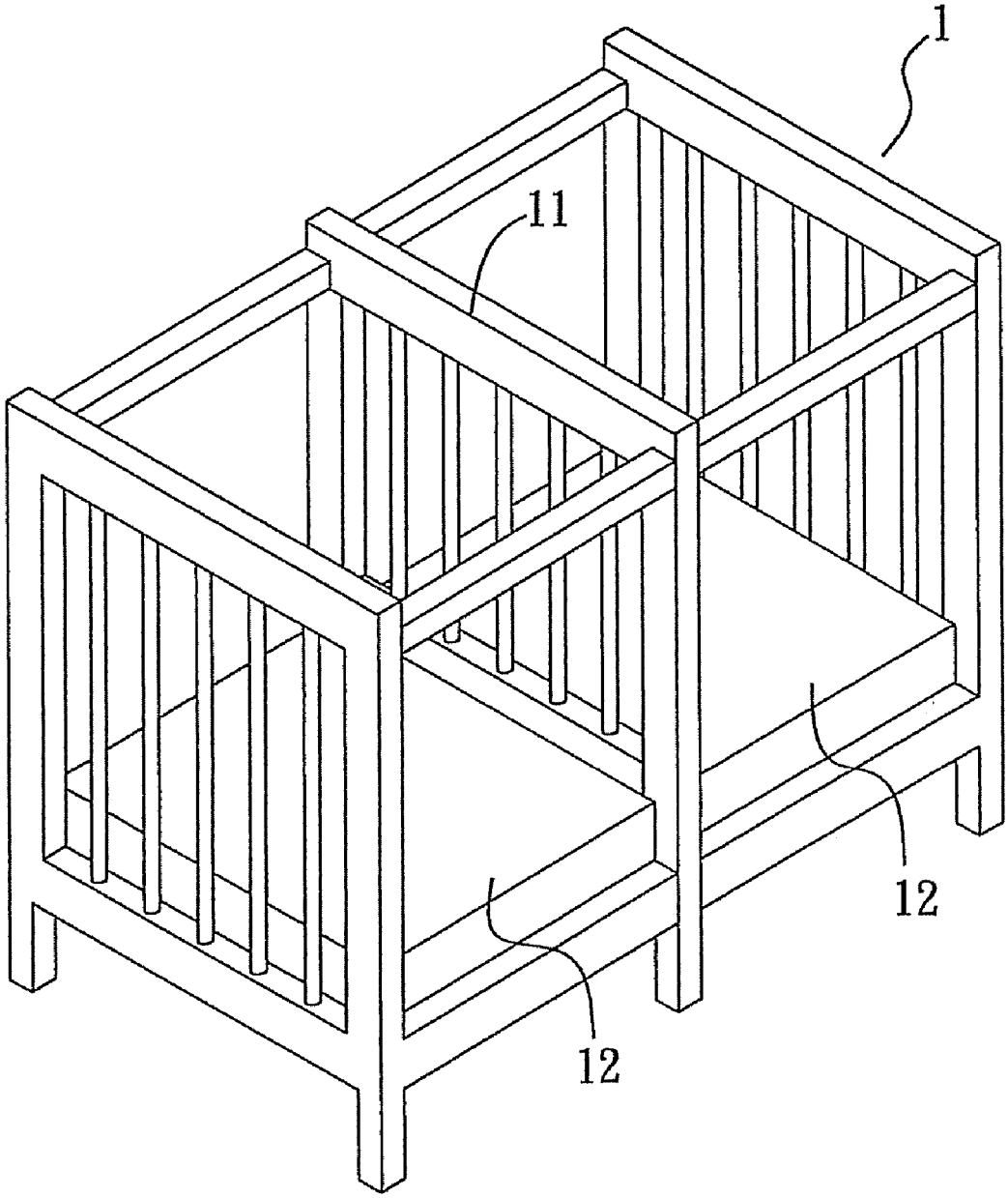
F I G. 1 PRIOR ART
FIG. 1 is a perspective view of a conventional baby crib as disclosed in British Patent No. 2333034.
Figure 2:
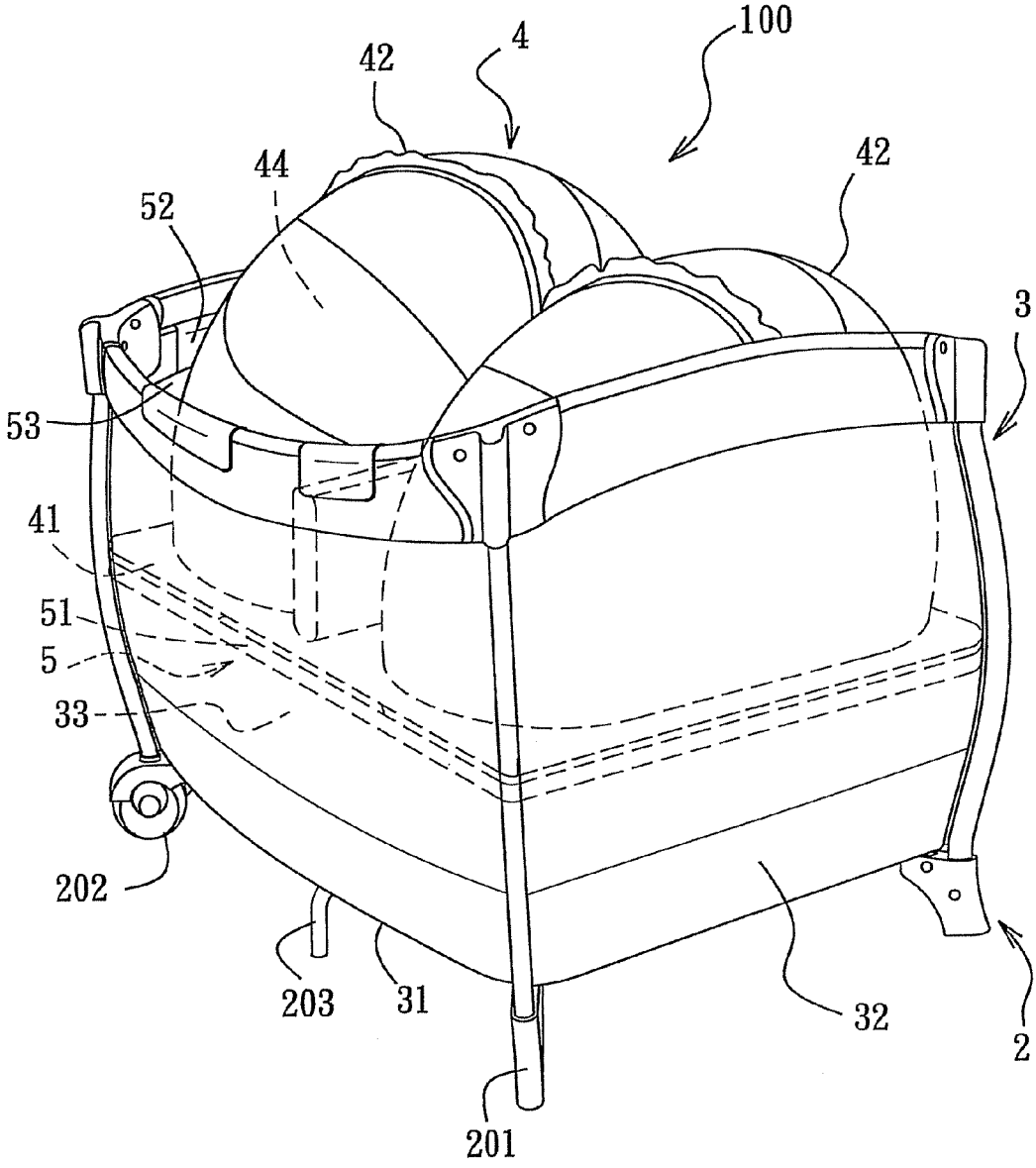
FIG. 2 is a perspective view of the first preferred embodiment of a combined crib and playpen assembly according to the present invention.
Figure 3:
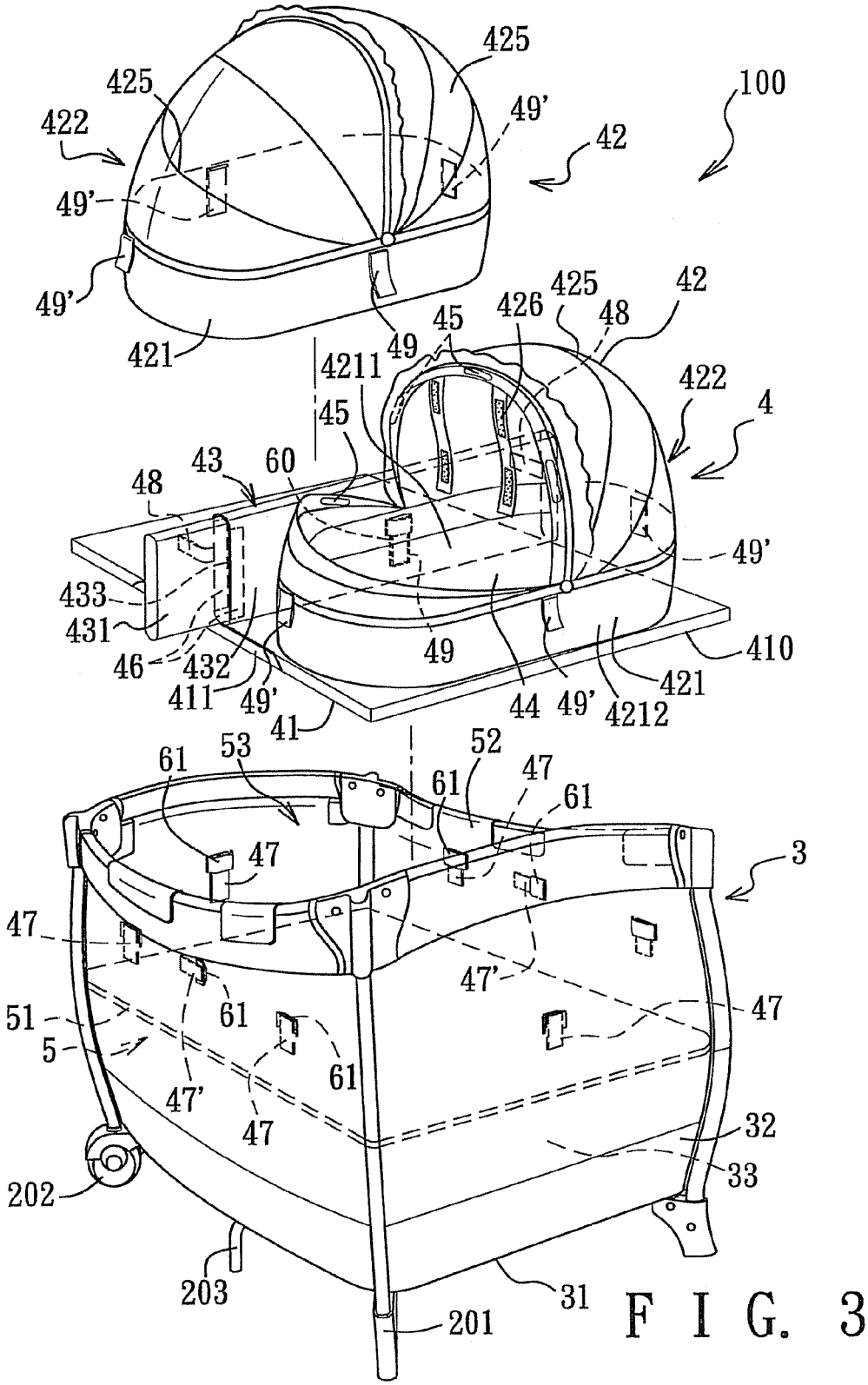
FIG. 3 is an exploded perspective view of the first preferred embodiment.

Before the present invention is described in greater detail, it should be noted that like elements are denoted by the same reference numerals throughout the disclosure.

Referring to FIGS. 2 to 5, the first preferred embodiment of a combined crib and playpen assembly 100 according to the present invention is shown to comprise a playpen body 3, a hanging bed 5, and a bassinet unit 4.

The playpen body 3 includes a first bottom wall 31, and a first surrounding wall 32 connected to and cooperating with the first bottom wall 31 to define a first receiving space 33 for providing a playing space for a baby. A leg frame 2 supports the playpen body 3 on the ground, and includes four spaced-apart leg members 201, two of which are provided with wheels 202. A supporting frame 203 is further provided on a central bottom portion of the playpen body 3 so as to support securely the playpen body 3 on the ground.

The hanging bed 5 is disposed removably within the playpen body 3, such as by a hooking method, and has a second bottom wall 51 spaced apart vertically from the first bottom wall 31, and a second surrounding wall 52 connected to and cooperating with the second bottom wall 51 to define a second receiving space 53. When the hanging bed 5 is mounted within the playpen body 3, the depth of the second receiving space 53 is such that it is suitable for the lying of an infant therein. When the hanging bed 5 is removed from the playpen body 3, the play pen body 3 is configured to provide a substantial playing space for an older baby through the first receiving space 33.

The bassinet unit 4 includes a base plate 41 disposed removably on the second bottom wall 51, two bassinet members 42, and a divider 43. The base plate 41 is flexible, and includes a cushion body 411, and a cushion-covering bag 410 made by sewing two fabric materials together for receiving removably the cushion body 411. The cushion-covering bag 410 has a bottom face formed with a central bottom opening 413 to facilitate removal and insertion of the cushion body 411 from and into the cushion-covering bag 410. When the bassinet unit 4 is not required, the cushion body 411 can be used singly by removing it from the cushion-covering bag 410 and placing it on the first or second bottom wall 31, 51.

The bassinet members 42 are supported on the base plate 41, and are adjacent to each other. Each of the bassinet members 42 includes a third surrounding wall 421 and a foldable hood 422. The third surrounding wall 421 is made of a fabric material, has a bottom peripheral edge sewn to a top face of the base plate 41, and surrounds a substantially oval-shaped contour. The third surrounding wall 421 cooperates with the top face of the base plate 41 to define a third receiving space 44, which is smaller than the second receiving space 53. The third surrounding wall 421 further has a first side portion 4211 adjacent to the first side portion 4211 of the third surrounding wall 421 of the other one of the bassinet members 42, and a second side portion 4212 adjacent to the second surrounding wall 52.

Figure 5:
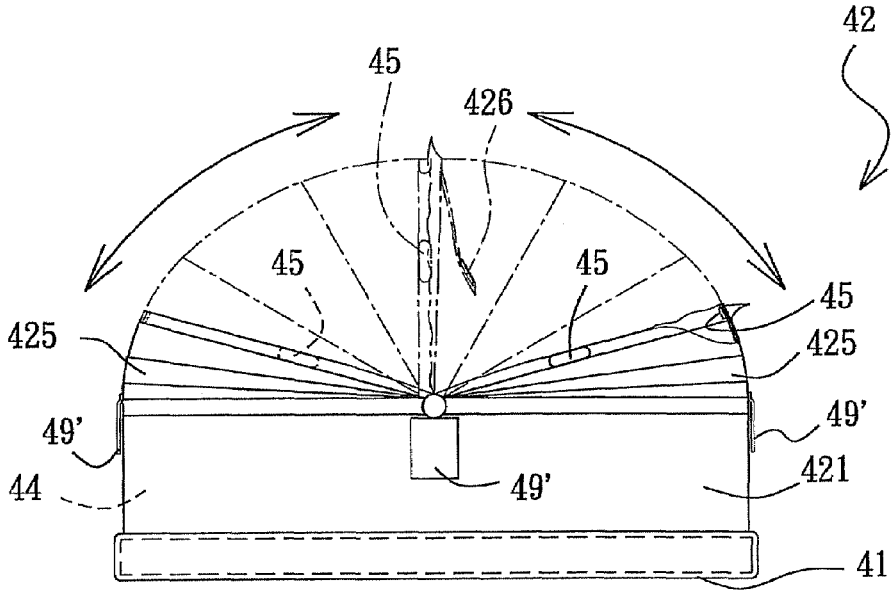
FIG. 5 is a schematic side view of a bassinet member of the first preferred embodiment.

The foldable hood 422 of each of the bassinet members 42 includes two foldable fabric hood portions 425 sewn to a top edge of the corresponding third surrounding wall 421 on opposite half portions thereof. When the hood portions 425 of each bassinet member 42 are moved upwardly toward each other so as to be unfolded, the third receiving space 44 is covered, as best shown in FIG. 5. When the hood portions 425 are moved downwardly so as to be folded on the top edge of the third surrounding wall 421, the third receiving space 44 is exposed. In this embodiment, the hood portions 425 of each of the bassinet members 42 are provided with hook-and-loop fasteners 45, i.e., Velcro (RTM) fasteners, so that when the hood portions 425 are unfolded, they can be adhered to each other through the fasteners 45.

Further, each bassinet member 42 is provided with two spaced-apart hanging straps 426 fixed to one of the hood portions 425 and sewn with male and female fasteners for hanging toys.

The divider 43 is connected to the base plate 41 at a central portion thereof, and extends between the first side portions 4211 of the third surrounding walls 421 of the bassinet members 42 so as to interconnect the same. The divider 43 includes a divider board 431, and aboard-covering bag 432 covering the divider board 431. The board-covering bag 432 has a bottom portion sewn to the top face of the base plate 41, an opening 433 to facilitate insertion or removal of the divider board 431 into or from the board-covering bag 432, and a closure member 46 attached to the board-covering bag to close openably the opening 433.

Figure 4:
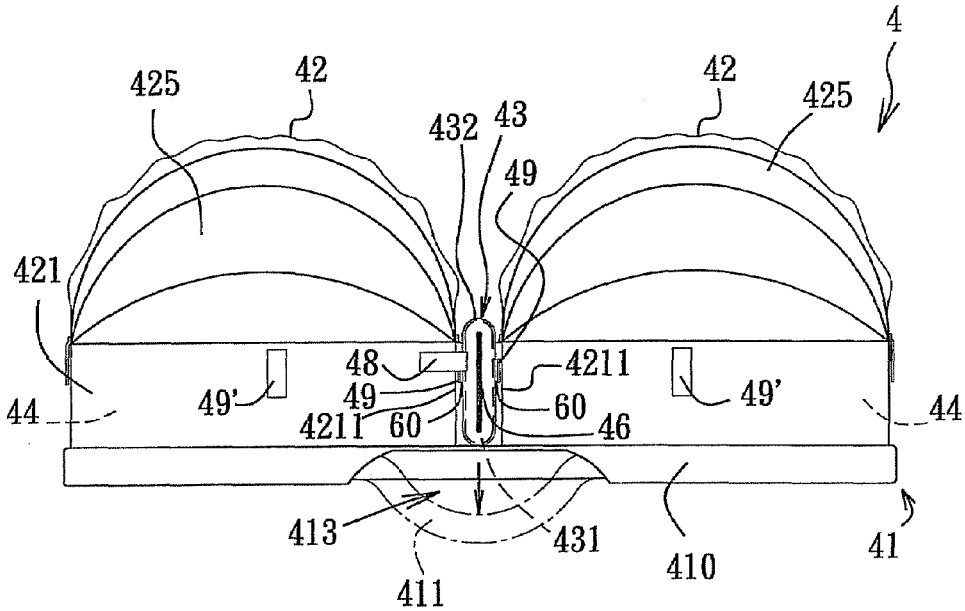
FIG. 4 is a schematic view of a bassinet unit of the first preferred embodiment in an assembled state.
Figure 6:
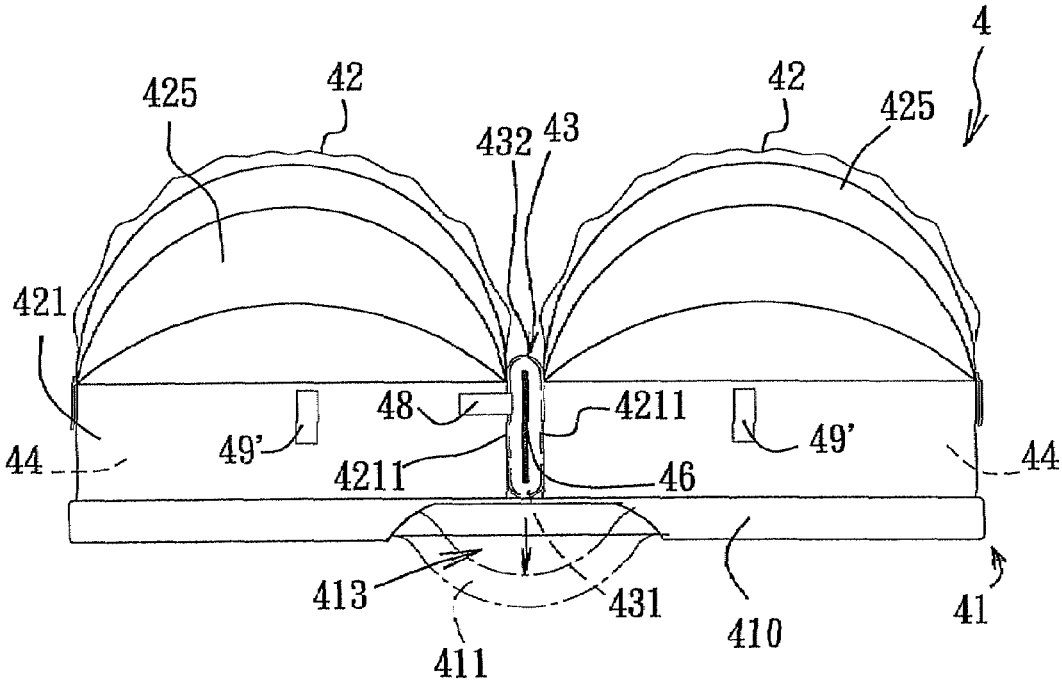
FIG. 6 is a view similar to FIG. 4, but without first fastening units between a divider and bassinet members of the bassinet unit.

The first side portions 4211 of the third surrounding walls 421 of the bassinet members 42 are fastened releasably and respectively to two opposite first sides of the divider 43, which face the respective first side portions 4211 of the third surrounding walls 421 of the bassinet members 42, through a plurality of first fastening units, as best illustrated in FIG. 4. The first fastening units are in the form of hook-and-loop fasteners 49, 60, i.e., Velcro (RTM) fasteners. In an alternative embodiment, as shown in FIG. 6, the first side portions 4211 of the third surrounding walls 421 of the bassinet members 42 are sewn respectively to two opposite sides of the board-covering bag 432 of the divider 43.

The second side portions 4212 of the third surrounding walls 421 of the bassinet members 42 are fastened releasably to the second surrounding wall 52 through a plurality of second fastening units, which are in the form of hook-and-loop fasteners 47, 49', i.e., Velcro (RTM) fasteners.

The divider 43 is fastened releasably to the second surrounding wall 52 through a plurality of third fastening units, which are in the form of hook-and-loop fasteners 48, 47', i.e., Velcro (RTM) fasteners.

The second surrounding wall 52 is further provided with a plurality of attachment rings 61 disposed proximate to the respective fasteners 47 so that the fasteners 48 and 49' can be inserted respectively therethrough and engage the respective fasteners 47', 47, thereby preventing easy removal of the fasteners 48 and 49'.

Alternatively, each of the first, second and third fastening units may be configured as snap fasteners, or other male and female fasteners.

Figure 7:
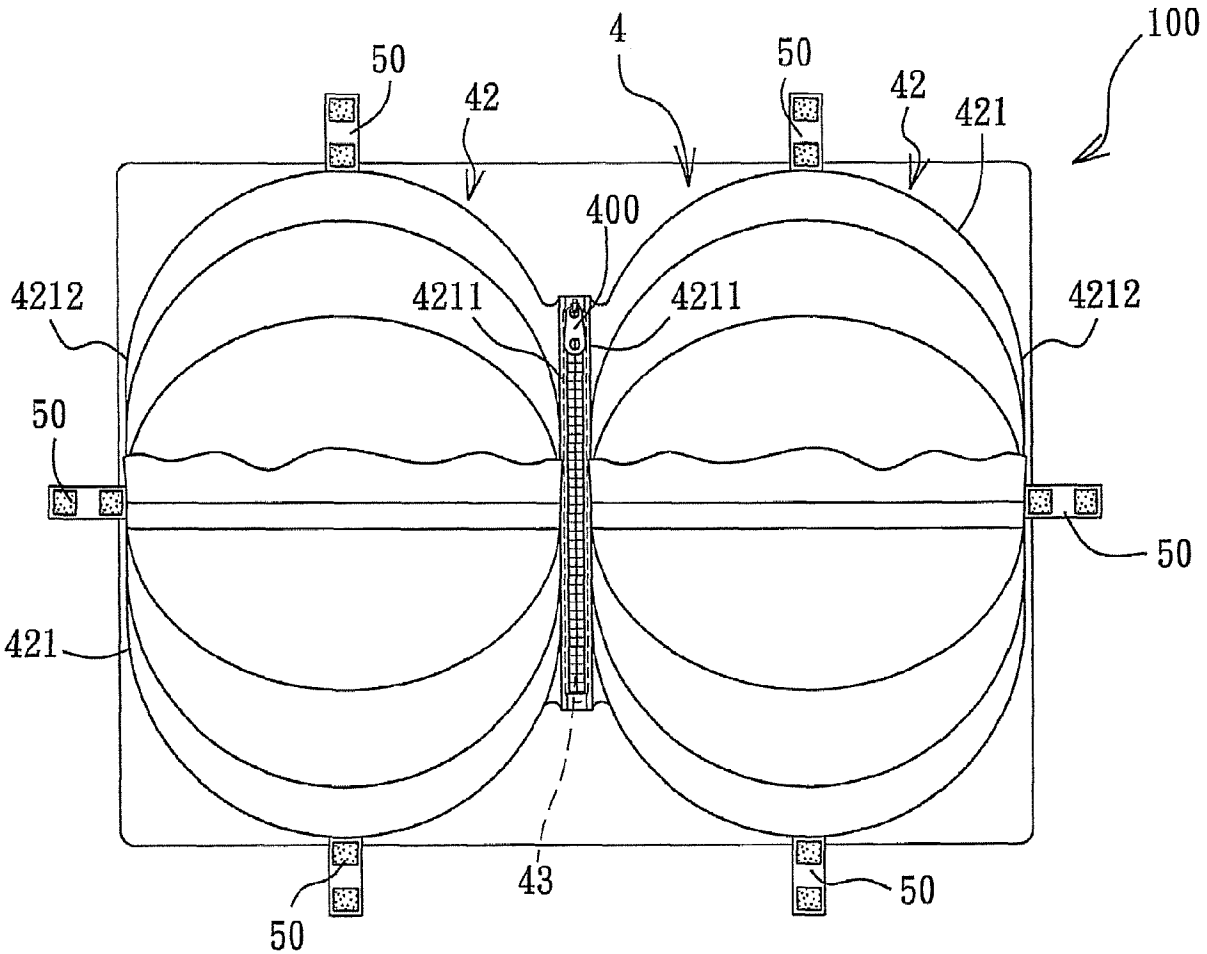
FIG. 7 is a schematic top view of the second preferred embodiment of a combined crib and playpen assembly according to the present invention.

Referring to FIG. 7, the second preferred embodiment of a combined crib and playpen assembly 100 according to the present invention is shown to be similar to the first preferred embodiment. However, in this embodiment, the first side portions 4211 of the third surrounding walls 421 of the bassinet members 42 have top edges interconnected to each other through a zipper 400. The divider 43 is made of a rigid board covered by a fabric material which has no opening 433 (see FIG. 3) to facilitate removal or insertion of the rigid board, and has smaller dimensions than those of the divider 43 in the first preferred embodiment, so that when the first side portions 4211 of the third surrounding walls 421 of the bassinet members 42 are interconnected, the divider 43 is located below the zipper 400. The second surrounding wall 52 (see FIG. 3) is provided only with attachment rings 61 (see FIG. 3). The second side portions 4212 of the third surrounding walls 421 of the bassinet members 42 are provided with fastening straps 50, each of which has a hook fastener and a loop fastener on one of its surfaces. Each of the fastening straps 50 is inserted into the corresponding attachment ring 61, and is then folded back so as to interengage the hook and loop fasteners.

From the aforementioned description, the advantages of the combined crib and playpen assembly 100 of the present invention can be summarized as follows:

1. The playpen body 3 cooperates with the hanging bed 5 to convert the combined crib and playpen assembly 100 from a playpen to a single baby bed, and further cooperates with the bassinet unit 4 to accommodate two babies simultaneously through the two bassinet members 42. Hence, the combined crib and playpen assembly 100 can comfortably accommodate (for sleeping) two infants or a single larger baby.

2. The divider 43 is disposed between the bassinet members 42 so as to prevent the babies from disturbing each other.

3. The foldable hood 422 can block light and noise, and prevent the babies from being bitten by mosquitoes during their sleep, thereby adding comfort when the bassinet members 42 are in use.

4. The fastening units are configured as hook-and-loop fasteners 47, 49', 48, 47', 49, 60, 50, so as to enable quick removal of the bassinet unit 4 from the playpen body 3.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

The invention claimed is:

1. A bassinet assembly comprising: a base plate; and a pair of bassinet members that are supported by said base plate and that are adjacent to each other and defining a receiving space, wherein said base plate includes a cushion-covering bag having a bottom opening, and a cushion body inserted removably into said cushion-covering bag through said bottom opening.

2. The bassinet assembly of claim 1, wherein said base plate is flexible, and each of said bassinet members includes a surrounding wall fixed to said base plate and defining said receiving space, and a foldable hood mounted on said surrounding wall, said surrounding wall having a bottom peripheral edge sewn to a top face of said cushion-covering bag.

3. The bassinet assembly of claim 2, wherein said foldable hood includes two foldable hood portions connected to a top edge of said surrounding wall.

4. The bassinet assembly of claim 2, wherein said surrounding wall of each of said bassinet members has a first side portion adjacent to said first side portion of said surrounding wall of the other one of said bassinet members, and a second side portion opposite to said first side portion.

5. The bassinet assembly of claim 4, wherein said first side portions of said surrounding walls of said bassinet members are connected to each other.

6. The bassinet assembly of claim 5, further comprising a zipper to interconnect said first side portions of said surrounding walls of said bassinet members.

7. The bassinet assembly of claim 5, further comprising a divider connected to said base plate and extending between said first side portions of said surrounding walls of said bassinet members.

8. The bassinet assembly of claim 7, wherein said divider includes a divider board, and a board covering bag covering said divider board, said board covering bag having an opening for insertion and removal of said divider board into and from said board covering bag, and a closure member attached to said board covering bag to close openably said opening.

* * * * *